US008684089B2

(12) United States Patent
Borhaug et al.

(10) Patent No.: US 8,684,089 B2
(45) Date of Patent: Apr. 1, 2014

(54) METHOD AND SYSTEM FOR CIRCULATING FLUID IN A SUBSEA INTERVENTION STACK

(75) Inventors: Kristian Borhaug, Asker (NO); Gunnar Herø, Vøenenga (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 674 days.

(21) Appl. No.: 12/735,221

(22) PCT Filed: Dec. 2, 2008

(86) PCT No.: PCT/NO2008/000426

§ 371 (c)(1),
(2), (4) Date: Oct. 1, 2010

(87) PCT Pub. No.: WO2009/082234

PCT Pub. Date: Jul. 2, 2009

(65) Prior Publication Data

US 2011/0011593 A1 Jan. 20, 2011

(30) Foreign Application Priority Data

Dec. 21, 2007 (NO) ..... 20076630

(51) Int. Cl.
*E21B 21/00* (2006.01)
*E21B 37/00* (2006.01)

(52) U.S. Cl.
USPC ..... 166/344; 166/351; 166/368; 166/311; 166/77.1; 166/90.1; 137/15.04

(58) Field of Classification Search
USPC ..... 166/311, 338, 339, 344, 351, 352, 357, 166/368, 312, 77.1, 90.1, 241.5; 137/15.01, 137/15.04, 15.05
See application file for complete search history.

(56) References Cited

U.S. PATENT DOCUMENTS

| | | | | | |
|---|---|---|---|---|---|
| 3,145,995 | A | * | 8/1964 | Adamson et al. | 166/53 |
| 3,500,907 | A | * | 3/1970 | Gentry | 166/70 |
| 3,532,163 | A | * | 10/1970 | Ecuer | 166/53 |
| 3,556,209 | A | * | 1/1971 | Reistle et al. | 166/352 |
| 3,637,009 | A | * | 1/1972 | James | 166/351 |
| 3,762,725 | A | * | 10/1973 | Taylor | 277/330 |
| 4,577,693 | A | * | 3/1986 | Graser | 166/338 |
| 4,673,041 | A | * | 6/1987 | Turner et al. | 166/340 |
| 4,821,799 | A | * | 4/1989 | Wong | 166/84.2 |
| 5,048,603 | A | * | 9/1991 | Bell et al. | 166/70 |
| 5,343,941 | A | * | 9/1994 | Raybon | 166/53 |
| 5,458,691 | A | * | 10/1995 | Daniels | 134/22.12 |
| 6,076,603 | A | * | 6/2000 | Perrin | 166/304 |

(Continued)

FOREIGN PATENT DOCUMENTS

| | | |
|---|---|---|
| GB | 689829 | 4/1953 |
| GB | 2 233 365 A | 1/1991 |
| WO | WO 01/25593 A1 | 4/2001 |
| WO | WO 2006/075181 A1 | 7/2006 |

*Primary Examiner* — Matthew Buck

(57) ABSTRACT

The present invention relates to a fluid circulation system for circulating fluid in a subsea cavity, the cavity being filled with a first fluid and having first and second end ports. The system comprises a container (26) containing a second fluid, fluid lines (21, 27) extending from the container to the first and second end ports of the cavity, respectively, and a pump (22) for exchanging the second fluid provided in the container (26) and the first fluid provided in the subsea cavity (10). The invention also relates to a method for circulating fluid in a subsea cavity.

22 Claims, 1 Drawing Sheet

(56) References Cited

U.S. PATENT DOCUMENTS

| | | | | |
|---|---|---|---|---|
| 7,331,393 | B1 * | 2/2008 | Hoel | 166/336 |
| 7,389,818 | B2 * | 6/2008 | Hoiland | 166/367 |
| 7,699,110 | B2 * | 4/2010 | Anderson et al. | 166/368 |
| 7,721,807 | B2 * | 5/2010 | Stoisits et al. | 166/366 |
| 7,819,195 | B2 * | 10/2010 | Ellis | 166/355 |
| 8,342,248 | B2 * | 1/2013 | Hall et al. | 166/344 |
| 2008/0277122 | A1 * | 11/2008 | Tinnen | 166/339 |
| 2010/0032163 | A1 * | 2/2010 | Richards et al. | 166/344 |
| 2011/0094749 | A1 * | 4/2011 | Richards et al. | 166/345 |
| 2011/0192610 | A1 * | 8/2011 | Machin et al. | 166/344 |

* cited by examiner

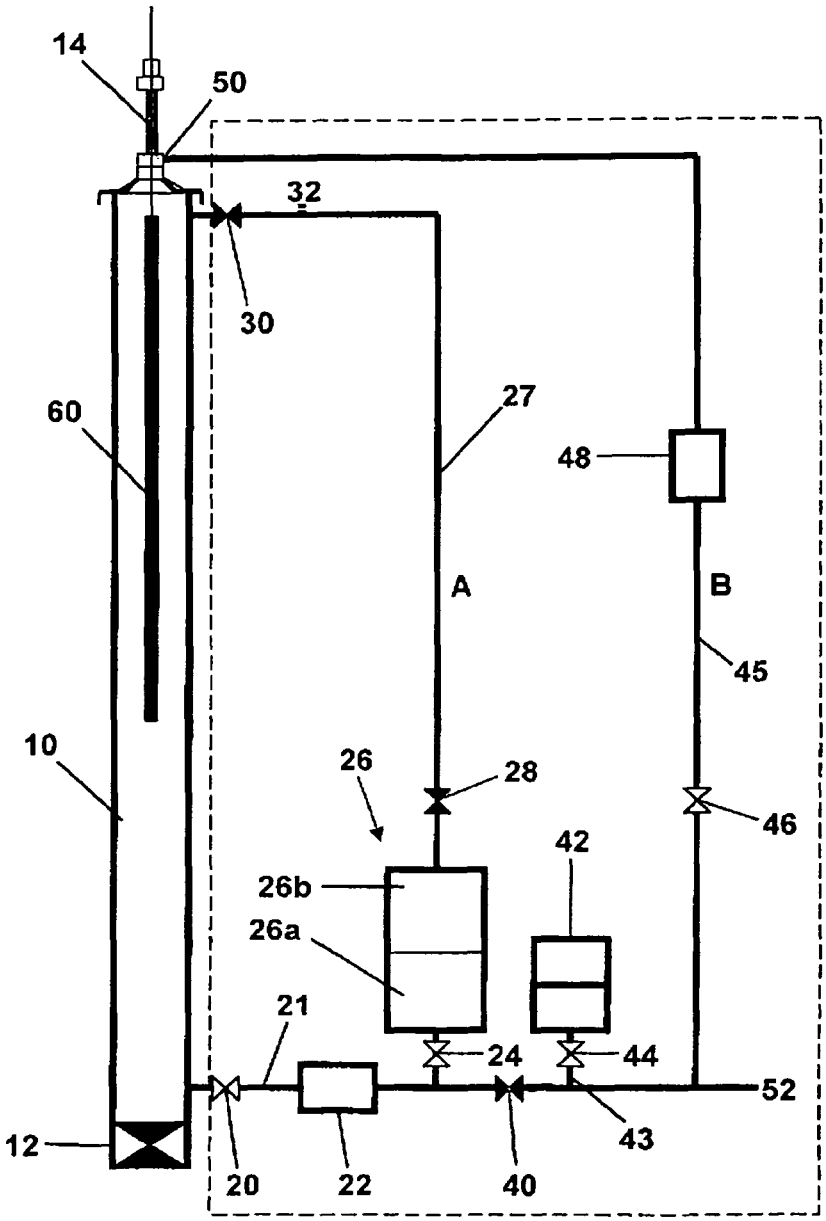
14
50
32
30
60
27
48
A
B
45
10
26
28
46
42
26b
26a
21
24
44
52
12
20
22
40
43

METHOD AND SYSTEM FOR CIRCULATING FLUID IN A SUBSEA INTERVENTION STACK

FIELD OF THE INVENTION

The present invention relates to a method and system for circulating fluid in a subsea intervention stack.

BACKGROUND OF THE INVENTION

When a subsea intervention stack is used for intervention work in subsea wells, producers or injectors, the subsea intervention stack has to be flushed both prior to, and after each wireline run. This is needed to flush seawater out of the subsea lubricator to prevent seawater from entering the wellbore but most importantly, to prevent hydrates forming when hydrocarbon comes into contact with free water. A hydrate inhibiting fluid, for example monoethylene glycol (MEG), is normally used.

Most commonly today MEG is supplied from a surface vessel by means of a hose or umbilical to the subsea intervention stack during an intervention operation. In todays systems, more MEG than needed is usually supplied to the subsea stack to be certain that no hydrates will form. One disadvantage is the larger costs involved with the MEG consumption, another is the environmental aspect in the cases where MEG is flushed to sea.

In addition to the mentioned issues, the use of hoses from surface is considered as costly and unwanted in deep water intervention work In WO 01/25593 (belonging to the applicant) it was suggested to use a flushing system that enabled the MEG and hydrocarbons in the stack bores to be flushed into the well or into the flowline. This avoided discharge to sea or bringing hydrocarbons to the surface, but had the disadvantage that forcing MEG of high pressure into the well might disturb the formation. Another disadvantage is that this system is also dependent upon hoses or umbilicals to supply the needed MEG to the subsea stack.

Moreover, U.S. Pat. No. 3,500,907 describes a closed flushing and vapour elimination system for cleaning wireline tools under conditions such as a subsea chamber at an underwater wellhead, where toxic and unpleasant fumes could be harmful to human operators. The system comprises two fluid lines for connection to a lubricator assembly, a pump and a fluid container.

The object of the present invention is to provide a method and device for circulating fluid in a subsea module where the above disadvantages are avoided.

It is an object of the invention to reduce the consumption of MEG, especially the volume of MEG that is dropped into the well. Moreover, it is an object to enable for cost efficient subsea intervention in deep water with use of a subsea intervention stack system.

Moreover, it is an object of the invention to allow for low power consuming subsea pump technology to handle the circulation of a fluid in a subsea intervention stack.

SUMMARY OF THE INVENTION

The present invention relates to a fluid circulation system for circulating fluid in a subsea cavity, the cavity being filled with a first fluid and having first and second end ports, where the system comprises:

a container containing a second fluid, fluid lines extending from the container to the first and second end ports of the cavity, respectively, characterized in that the system further comprises:

a pump for exchanging the second fluid provided in the container and the first fluid provided in the subsea cavity.

In an aspect of the invention, the subsea cavity is a bore in a subsea lubricator stack.

In an aspect of the invention, the volume of the container is substantially similar to the volume of the cavity.

In an aspect of the invention, the pump is exchanging fluid by pumping the second fluid provided in the container into the cavity through the first fluid line while displacing the first fluid provided in the cavity into the container through the second fluid line or vice versa.

In an aspect of the invention, the first fluid is a hydrate inhibiting fluid.

In an aspect of the invention, the first fluid is seawater.

In an aspect of the invention, the first fluid is a well fluid or is a fluid compatible with well fluids.

In an aspect of the invention, the second fluid is a hydrate inhibiting fluid.

In an aspect of the invention, the system comprises a second container containing a hydrate inhibiting fluid;

fluid lines for connection of the second container to the cavity;

a second pump for pumping said hydrate inhibiting fluid from the second tank to the cavity through the fluid lines.

In an aspect of the invention, the tank comprises a first chamber, a second chamber separate from the first chamber, and pressure balancing means for pressure communication between the first chamber and the second chamber; and valves for controlling the fluid flow in the fluid circulation system.

In an aspect of the invention, the first and second container are lowered to the seabed in a separate operation and are connected to the fluid lines at subsea.

In an aspect of the invention, the fluid circulation system including the first and second containers are lowered to the seabed in a separate operation and are connected to the subsea intervention stack bores by means of the connection means at subsea.

In an aspect of the invention, a first fluid loop, comprising the fluid lines, comprises a first end connected to the lower end of the main bore section and a second end connected to the upper end of the main bore section, where valves are provided for opening and closing the first and second ends of the first fluid loop respectively.

In an aspect of the invention, the first chamber of the first container comprises a opening/closing valve in fluid communication with the valve for closing the first end of the first fluid loop, where the first pump system is located between the valve for closing the first end of the first fluid loop, and the second chamber of the first tank system comprises a opening/closing valve in fluid communication with the valve for closing the second end of the first fluid loop.

In an aspect of the invention, a second fluid loop, comprising the fluid line, comprises a first end connected between the first pump system and the opening/closing valve of the first chamber and a second end comprising an outlet for injection of hydrate inhibiting fluid from the second tank system into a pressure control head provided above the main bore section by means of the second pump system.

The present invention also relates to a method for circulating fluid in a subsea cavity, where the method comprises the following steps:

submerging a fluid circulation system comprising a container and fluid lines;

connecting the fluid lines between the container and the ports at each end of the cavity; characterized in that the method further comprises:

exchanging a fluid provided in the container and the fluid provided in the subsea cavity.

In an aspect of the invention, the exchanging is performed by pumping the fluid provided in the container into the cavity through the first fluid line while displacing the fluid provided in the cavity into the container through the second fluid line or vice versa.

In an aspect of the invention, the method further comprises:

displacing the existing fluid in the cavity to sea by pumping a fluid corresponding to the second fluid from a second container into the cavity;

exchanging said second fluid in the cavity with the first fluid provided in the first container.

In an aspect of the invention, the method comprises:

pumping the second fluid from the bore into the second container while filling seawater in the container before disconnecting the subsea intervention stack from the fluid circulation system.

DETAILED DESCRIPTION

In the following, embodiments of the invention will be described with reference to the enclosed drawing, illustrating a system for circulating fluid in a subsea intervention stack.

In the description, the hydrate inhibiting fluid used is monoethylene glycol (MEG), however, any hydrate inhibiting fluid can be used, such as methanol, glycol, brine etc.

The subsea intervention stack usually comprises five main submodules, a well control package (WCP) for connection to a Christmas tree, a lower lubricator package (LLP), a lubricator pipe, an upper lubricator package (ULP) and a pressure control head (PCH). These submodules are considered known for a man skilled in the art, and will not be described in detail here.

FIG. 1 illustrates part of a lubricator system showing a schematic of the lubricator pipe with its main bore 10 and showing the main bore valve 12 of the WCP. The upper end will be connected to the PCH (indicated by reference number 14). It should be noted that together with the main bore section 10 there might be several other, substantially smaller, bores of the lubricator and/or the subsea intervention stack that will be flushed, however these are not included in the drawing. All the bores that are flushed according to the invention, are denoted subsea intervention stack bores.

Among several other things, the PCH 14 comprises a stuffing box or grease injector head for slidable but sealed lead-through of a cable or wire which is suspending a tool 60 that is to be inserted into the well during the intervention.

The present embodiment of the invention comprises a fluid circulation system indicated by a dashed box in FIG. 1. The fluid circulation system comprises a tank or container 26 being part of a fluid circulation loop marked as A on the FIGURE. The tank 26 is at one end connected to the lower end of the main bore section 10 with a fluid line 21 having control valves 20 and 24. The tank is at its other end connected to the upper end of the main bore section 10 with a fluid line 27 having valves 28 and 30. A pump system 22 is arranged in fluid line 21. A stab 32 is arranged in line 27 between the valves 28 and 30.

A second fluid circulation loop is marked B in FIG. 1. The second fluid circulation loop B comprises a fluid line 45 that extends from a point in the first fluid circulation loop A, between the pump 22 and the valve 24, and the PCH 14 (at outlet 50). Control valves 40 and 46 are arranged in fluid line 45. A tank or container 42 is via line 43 in fluid communication with line 45, having a control valve 44. The tank 42 is preferably pressure balanced against the ambient pressure. A second pump 48 is arranged in line 45.

The second fluid circulation loop B can both be used as storage for hydrate inhibiting fluid and to enable hydrate inhibiting fluid to be injected into the PCH 14 as needed.

It should be noted that there might be provided several outlets for the second fluid circulation loop B, for example the MEG pumped from the second tank system 42 by means of the second pump system 48 can be used to perform pressure testing of valves in the intervention stack.

The pump 22 is preferably a bidirectional pump, or may alternatively be two separate pumps, so that fluid can be pumped it both directions. For example, the first pump system can be a fixed displacement pump or a propulsion pump. Advantageously, a fixed displacement pump or piston pump is able to control the volume pumped by counting the number of revolutions or strokes. When other types of pumps are used, a volume controlling device or a liquid detector should be used to prevent well fluid from being pumped into the MEG part of the tank system 42.

Alternatively, one can also say that the first valve and the first pump system 22 are common for both the first and second fluid circulation loops A and B.

The pumps may be located inside the tanks, pump 22 in tank 26 and pump 48 in tank 42, respectively. The system may also comprise flow meters (not shown) for control of the amount of fluid entering or leaving the tanks.

The fluid circulation loop also comprises hydraulic coupling means for connecting the lines to the bores of the subsea intervention stack.

A second stab 52 is connected to the fluid connection between the fifth valve 40 and a sixth valve 46.

In one embodiment of the invention the tank 26 comprises a first chamber 26*a* and a second chamber 26*b* divided by a floating piston or membrane device for pressure balancing. Alternatively, the tank 26 may comprise two separate tanks, with pressure balancing between the fluids provided by means of a barrier fluid, for example nitrogen gas. Both these alternatives enable a low power consuming pump system due to balanced pressure conditions.

In this case the lower chamber 26*a* will contain MEG, while the upper chamber 26*b* contains either a well fluid or a fluid compatible with the fluids found in the well.

Advantageously the volume of the respective chambers 26*a*, 26*b* are each approximately the same as the volume of the subsea intervention stack bores.

The fluid circulation system may be provided as a retrievable unit adapted for connection to the main bore section 10 when placed subsea by means of fluid connection interfaces. Consequently, the fluid circulation system can be submerged to the sea bed independently, i.e. in a separate operation. In an alternative embodiment, the first and/or second tank 26, 42 may be separate modules, while the other parts of the first and second fluid circulation loops A, B are provided as a part of the subsea intervention stack. Here, connection means are provided for subsea connection of the respective tank systems 26, 42 to the first and second fluid circulation loops A, B.

The operational method of using the present embodiment for flushing of a subsea lubricator will now be described in detail. The operation and function of the elements of the above first and second fluid circulation loops A, B will also appear from this section.

In an intervention operation, the subsea intervention stack (comprising the WCP, the LRP and the lubricator pipe) is lowered from a vessel to the seabed, and is connected to the Christmas Tree (XT). For more details on this process referral is made to the aforementioned WO 01/25593.

Then the PCH is attached around the cable or wire at the vessel and the tool connected to the end of the wire. The assembly is then lowered to the seabed and connected to the top of the lubricator. The tool is now held inside the lubricator pipe, ready to be lowered into the well.

In a first embodiment of the invention the main bore section 10 (and the other bores of the subsea intervention stack) is filled with MEG. Since MEG is much heavier than water it is envisaged that the MEG will stay in place during the lowering of the stack. The small amount of seawater that may enter the bore 10 during lowering will be displaced by the tool as it enters the bore. The tank 26 is filled with a well (compatible) fluid. The valves 20, 24, 28, 30 are opened. The pump 22 is now started to push fluid through line 27 and into the bore 10. This will displace the MEG in the bore 10 into fluid line 21 and into the tank 26. When the bore 10 is filled with well fluid the valve 12 (and the XT valves) can be opened and the tool lowered into the well. The valves 20 and 30 are closed.

After the well operation the tool is raised into the lubricator bore 10. After the valve 12 has closed the valves 20 and 30 are again opened and the pump 22 is started in the opposite direction to pump the MEG from the tank 26 into the bore 10 through line 21. This will cause the well fluid in the stack bore to flow back into the tank 26 through line 27. It should be noted that the second tank 42 is not needed in the first embodiment described above.

In a second embodiment the lubricator stack is not filled with MEG before lowering into the sea. This will cause seawater to enter the bore 10. The tank 26 is as before filled with a well fluid. The tool 60 is (together with the PCH) lowered to the lubricator stack and attached thereto. The seawater in the stack must be flushed out before intervention can begin. Now the valves 20, 24 and 44 are opened and the pump 22 started, forcing MEG from tank 42 and into lubricator bore 10. This will displace the seawater in the stack. The seawater is flushed to sea, through a dedicated port (not shown) located within the stack.

The bore 10 is now filled with MEG. In the next step the MEG is displaced with well fluids in the same manner as described above, i.e. by exchanging fluids in the tank 26.

In a third embodiment the chambers 26*a* and 26*b* is filled with MEG and well fluids, respectively. The bore 10 is filled with water as before. First the pump 22 is operated to pump MEG from the first chamber 26*a* through line 21 into the bore 10. The seawater in the bore 10 is flushed to sea, as described earlier. In the next step the pump is reversed to pump well fluid stored in the second chamber 26*b* through line 27 into the subsea intervention stack bores. This displaces the MEG in the bore 10 which is flushed back to the chamber 26*a*. Now the main bore valve 12 can be opened and downhole operations begin, with use of dedicated tool 60.

When the tool 60 is back in the main bore section, the main bore valve 12 is closed while valves 20, 24, 28 and 30 are opened. The pump system 22 is now operated to pump the MEG from the first chamber of the tank system 26 through valves 20 and 24 into the subsea intervention stack bores. This will displace the well fluid in the lubricator through valves 30 and 28, and into the second chamber 26*b* of the tank system 26.

In all embodiments, in the final step of the subsea operation the PCH 14 and tool 60 is retrieved to surface for reconfiguration. A new tool 60 can now be configured for next wireline run. Since MEG is heavier than seawater, most of the MEG will stay in the subsea intervention stack bores and not leak to sea.

After the last wireline run, the well fluid has been flushed into the tank system 26 and the bores in the stack is filled with MEG. The PCH 14 and the tool 60 are retrieved to surface. Before the subsea stack is disconnected, the MEG is pumped from the stack bores through valves 20, 40 and 44 into the second tank system 42 with use of pump system 22, while seawater is entering through the above mentioned port. Now the subsea intervention stack bores will be filled with seawater and the stack can be disconnected from the XT and retrieved to surface.

Since the pressure of the fluid in the stack bores is balanced with the pressure of the first fluid circulation loop A, and with the second tank system 42 in loop B, the pump system 22 can be a low pressure pump with relatively low power consumption.

The operation of the valves, the pump systems and the first and second tank systems are controlled by a control system either manually or substantially automatically.

As a contingency, MEG could be supplied to the subsea system through stab 52, with use of a hose from surface. Additionally the port 32 could be used to bleed of well fluid pressure. Also the tank 42 can be retrieved to surface and refilled.

According to the invention it is achieved that the consumption of MEG is considerably reduced. Also the energy consumption is relatively low, since low pressure pumps can be used. Moreover, the method and device is independent of sea depth.

Further modifications and variations will be obvious for a skilled man when reading the description above. The scope of the invention will appear from the following claims and their equivalents.

Although the invention is exemplified for use in a subsea lubricator system someone skilled in the art will realize that the invention can be used for other purposes. One such may be the flushing of a subsea part before it is disconnected from the system. Such parts may for example be pumps, separators, flowloops, pigloops or other parts or cavities that may contain hydrocarbons.

The invention claimed is:

1. A fluid circulation system for circulating fluid in a subsea cavity, the cavity being filled with a first fluid and having first and second end ports, the system comprising:

a first container containing a second fluid, first and second fluid lines extending from the first container to the first and second end ports, respectively, and a first pump which is connected to one of the first and second fluid lines;

wherein when the pump is activated the subsea cavity is filled with the second fluid from the first container while the first container is filled with the first fluid from the subsea cavity.

2. The system according to claim 1, wherein the subsea cavity is a bore in a subsea lubricator stack.

3. The system according to claim 1, wherein the volume of the first container is substantially similar to the volume of the cavity.

4. The system according to claim 1, wherein the first pump pumps the second fluid from the first container into the cavity through the first fluid line and thereby displaces the first fluid from the cavity into the first container through the second fluid line.

5. The system according to claim 4, wherein the first fluid is a hydrate inhibiting fluid.

6. The system according to claim 4, wherein the first fluid is seawater.

7. The system according to claim 4, wherein the first fluid is a fluid which is compatible with well fluids.

8. The system according to claim 4, wherein the second fluid is a hydrate inhibiting fluid.

9. The system according to claim 1, further comprising:

a second container containing a hydrate inhibiting fluid;

at least a third fluid line connecting the second container to the cavity; and a second pump for pumping said hydrate inhibiting fluid from the second container to the cavity through the third fluid line.

10. The system according to claim 1, wherein the first container comprises a first chamber which is connected to the first fluid line and a second chamber separate from the first chamber which is connected to the second fluid line, and wherein the first chamber is pressure balanced with the second chamber.

11. The system according to claim 9, wherein the first and second containers are configured to be lowered to the seabed and connected to their corresponding fluid lines subsea.

12. The system according to claim 9, wherein the fluid circulation system comprising the first and second containers is lowered to the seabed and connected to the cavity subsea.

13. The system according to claim 1, wherein a first fluid loop comprising the first and second fluid lines comprises a first end which is connected to the first end port and a second end which is connected to the second end port, and wherein the system comprises at least first and second valves for opening and closing the first and second ends, respectively.

14. The system according to claim 10, further comprising:

a first valve which is positioned in the first fluid line for controlling flow through the first end port;

a second valve which is positioned in the second fluid line for controlling flow through the second end port;

a third valve which is positioned between the first chamber and the first valve; and a fourth valve which is positioned between the second chamber and the second valve;

wherein the first pump is located between the first and third valves.

15. The system according to claim 9, wherein the first container comprises a first chamber and a second chamber separate from but pressure balanced with the first chamber, and wherein a fluid loop comprising the third fluid line comprises a first end connected between the first pump and a valve of the first chamber and a second end comprising an outlet for injection of hydrate inhibiting fluid from the second container into a pressure control head located above the subsea cavity.

16. A method for circulating fluid in a subsea cavity which comprises first and second ports located at opposite ends of the cavity, the method comprising the steps of:

submerging a fluid circulation system comprising a first container and first and second fluid lines;

connecting the first and second fluid lines between the first container and the first and second ports, respectively; and replacing a first fluid in the first container with a second fluid from the subsea cavity and the second fluid in the subsea cavity with the first fluid from the first container.

17. The method according to claim 16, wherein the replacing step is performed by pumping the first fluid from the first container into the cavity through the first fluid line to thereby displace the second fluid from the cavity into the first container through the second fluid line.

18. The method according to claim 17, wherein the cavity is initially filled with seawater and the method further comprises:

prior to the replacing step, displacing the seawater in the cavity to sea by pumping a fluid corresponding to the second fluid from a second container into the cavity.

19. The method according to claim 18, wherein the subsea cavity is a bore in a subsea intervention stack.

20. The method according to claim 19, further comprising:

exchanging said first fluid in the bore with the second fluid in the first container; and then pumping the second fluid from the bore into the second container while filling the bore with seawater before disconnecting the subsea intervention stack from the fluid circulation system.

21. The method according to claim 16, wherein the second fluid is a hydrate inhibiting fluid.

22. The method according to claim 16, wherein the first fluid is a fluid which is compatible with well fluids.

* * * * *